United States Patent [19]

Shimoie et al.

[11] Patent Number: 4,736,647

[45] Date of Patent: Apr. 12, 1988

[54] VALVE CONTROL STRUCTURE FOR WORKING VEHICLE

[75] Inventors: Shizuo Shimoie, Sakai; Kazuhiko Tsuji, Izumi; Masahiko Kobayashi, Sakai, all of Japan

[73] Assignee: Kubota, Ltd., Osaka, Japan

[21] Appl. No.: 937,504

[22] Filed: Dec. 3, 1986

[30] Foreign Application Priority Data

| | | | |
|---|---|---|---|
| Dec. 3, 1985 | [JP] | Japan | 60-186165[U] |
| Feb. 28, 1986 | [JP] | Japan | 61-29952[U] |
| Nov. 10, 1986 | [JP] | Japan | 61-172123[U] |

[51] Int. Cl.[4] ..... G05G 9/02; F15B 13/06

[52] U.S. Cl. ..... 74/471 XY; 74/471 R; 137/635; 137/636.2; 180/333; 180/334

[58] Field of Search ..... 74/471 R, 471 XY; 137/636.2, 635; 180/333, 334

[56] References Cited

U.S. PATENT DOCUMENTS

| | | | |
|---|---|---|---|
| 4,098,286 | 7/1978 | Prime | 74/471 XY |
| 4,398,861 | 8/1983 | Shimoie | 74/471 XY |
| 4,541,161 | 9/1985 | Shimoie | 74/469 X |
| 4,553,446 | 11/1985 | Matsubara | 74/471 R |
| 4,646,778 | 3/1987 | Tsuji et al. | 137/635 X |

FOREIGN PATENT DOCUMENTS

| | | |
|---|---|---|
| 60-211522 | 10/1985 | Japan . |
| 2159492 | 12/1985 | United Kingdom . |

*Primary Examiner*—Allan D. Herrmann

*Attorney, Agent, or Firm*—Edwin E. Greigg

[57] ABSTRACT

A valve control structure for a working vehicle comprising a control lever rockable crosswise, a first input rod pushed and pulled by rocking movements in a first direction of the control lever, a second input rod pushed and pulled by rocking movements in a second direction of the control lever, a first output rod connected to a first valve, a second output rod connected to a second valve, and an interlock switching device including bellcranks provided between the input rods and the output rods. The interlock switching device is operable to switch interlocking relationship between the input and output rods through the bellcranks. In one interlocking relationship, the first valve is controlled by rocking movements in the first direction of the control lever and the second valve by rocking movements in the second direction of the control lever. In the other interlocking relationship, the second valve is controlled by the rocking movements in the first direction of the control lever and the first valve by the rocking movements in the second direction of the control lever.

7 Claims, 7 Drawing Sheets

VALVE CONTROL STRUCTURE FOR WORKING VEHICLE

BACKGROUND OF THE INVENTION (1) Field of the Invention

The present invention relates to a valve control structure for a working vehicle, and more particularly to a valve control structure in which one of two valves is controlled by rocking movements in a first direction of a control lever rockable crosswise and the other valve by rocking movements in a second direction of the control lever. This valve control structure includes means to interchange the controls of the two valves with respect to the rocking directions of the control lever.

(2) Description of the Prior Art

This type of valve control structure is disclosed, for example, in U.S. Pat. No. 4,541,161. According to the known structure, a relay device in mounted in a connecting rod mechanism interconnecting valves and a mechanism for converting rocking movements of a control lever into linear movements. Valve control lines are changeable with respect to rocking directions of the control lever by changing an attachment arrangement of rods between the rocking/linear movement converting mechanism and the relay device and between the valves and the relay device.

Another known example is disclosed in the Japanese patent application laid open under No. 60-211522 (which corresponds to the British patent application published under No. GB No. 2159492A). The control structure disclosed therein comprises a connecting rod mechanism including a cam type cross-over switch mechanism and mounted between a rocking/linear movement converting mechanism and valves. The relay device and the cross-over switch mechanism both have very large constructions, which are not only expensive to manufacture but require a large accommodating space. Furthermore, the relay device and the cross-over switch mechanism are mounted between the rocking/-linear movement converting mechanism and the valves, and require connecting rods to be connected to the converting mechanism and connecting rods to be connected to the valves. This results in a complicated interlocking structure involving many constituent elements. It is troublesome and time-consuming to assemble the interlocking structure by incorporating one element after another into a vehicle body during a vehicle assembly process. Therefore, the vehicle is assembled and manufacture with a very poor efficiency.

SUMMARY OF THE INVENTION

An object of the present invention is to provide a valve control structure comparable in function with the known control structures and yet easy to assemble into the vehicle during the vehicle assembly process. This advantageous valve control structure results from the rational incorporation thereinto of a mechanism for switching the interlocking relationship between a first and a second connecting rods and a first and a second valves.

In order to achieve the above object, a valve control structure according to the present invention comprises a control lever rockable crosswise, a first input rod means operatively connected to the control lever to be pushed and pulled by rocking movements in a first direction of the control lever, a second input rod means operatively connected to the control lever to be pushed and pulled by rocking movements in a second direction of the control lever, a first output rod means connected to a first valve, a second output rod means connected to a second valve, and interlock switching means provided between the first and second input rod means and the first and second output rod means, the interlock switching means including a first bellcrank mechanism connected to the first output rod means and connectable to the first input rod means, a second bellcrank mechanism connecded to the second output rod means and selectively connectable to the first input rod means and the second input rod means, a third bellcrank mechanism connected to the first output rod means and connectable to the second input rod means, and a switch mechanism for shifting the first and second input rod means in directions crossing longitudinal axes thereof, wherein the interlock switching means is operable through the switch mechanism to effect switching selectively between a first interlocking relationship in which the first input rod means is connected to the first bellcrank mechanism and the second input rod means is connected to the second bellcrank mechanism thereby to control the first valve with rocking movements in the first direction of the control lever and to control the second valve with rocking movements in the second direction of the control lever, and a second interlocking relationship in which the first input rod means is connected to the second bellcrank mechanism and the second input rod means is connected to the third bellcrank mechanism thereby to control the second valve with the rocking movements in the first direction of the control lever and to control the first valve with the rocking movements in the second direction of the control lever.

In the above structure, the interlocking relationship is switched by changing positions of connection between the input rod means and the bellcrank mechanisms. This structure may be modified within the scope of the present invention such that the interlocking relationship is switched by changing positions of connection between the output rod means and the bellcrank mechanisms. Such a modified structure comprises interlock switching means including a first bellcrank mechanism connected to the second input rod means and connectable to the first output rod means, a second bellcrank mechanism connecded to the first input rod means and selectively connectable to the first output rod means and the second output rod means, a third bellcrank mechanism connected to the second input rod means and connectable to the second output rod means, and a switch mechanism for shifting the first and second output rod means in directions crossing longitudinal axes thereof, wherein the interlock switching means is operable through the switch mechanism to effect switching selectively between a first interlocking relationship in which the first output rod means is connected to the second bellcrank mechanism and the second output rod means is connected to the third bellcrank mechanism thereby to control the first valve with rocking movements in the first direction of the control lever and to control the second valve with rocking movements in the second direction of the control lever, and a second interlocking relationship in which the second output rod means is connected to the second bellcrank mechanism and first second output rod means is connected to the first bellcrank mechanism thereby to control the second valve with the rocking movements in the first direction of the control lever and to control the first valve with the rocking movements in the second direction of the control lever.

Other objects, features and advantages of the present invention will be apparent from the following description.

BRIEF DESCRIPTION OF THE DRAWINGS

The drawings illustrate a valve control structure embodying the present invention, in which.

DESCRIPTION OF THE PREFERRED EMBODIMENTS

An embodiment of the present invention will now be described with reference to the drawings.

Figure 1:
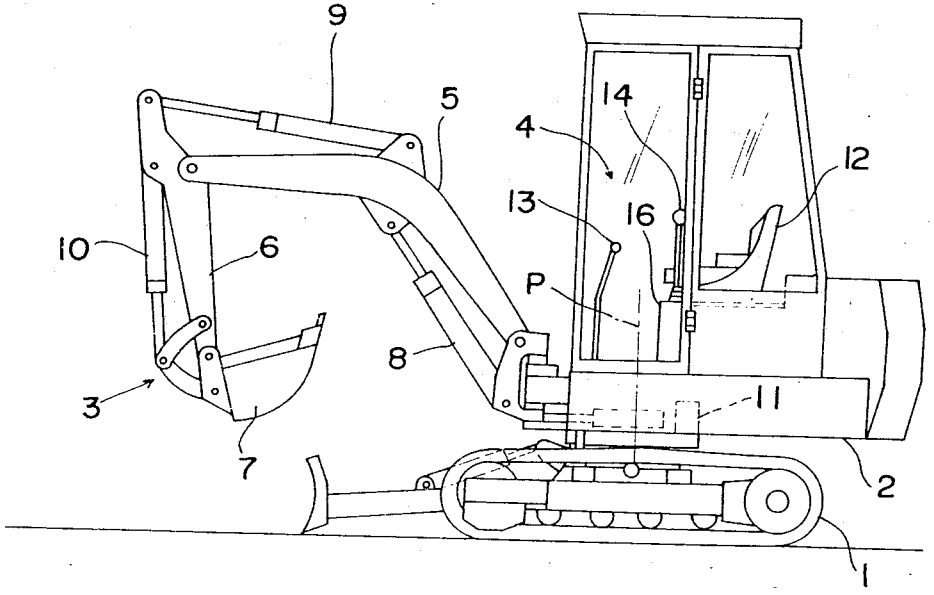
FIG. 1 is a side elevation of a working vehicle.

As shown in FIG. 1, a backhoe which is one example of working vehicle comprises a caterpiller traveling device 1 carrying a swivel deck 2. The swivel deck 2 carries a backhoe implement 3 and a driver's section 4.

The backhoe implement 3 includes a boom 5 pivotally supported by the swivel deck 2, an arm 6 pivotally supported by the boom 5, and a bucket 7 pivotally supported by the arm 6. The boom 5, arm 6 and bucket 7 are driven for pivotal movement by hydraulic cylinders 8, 9 and 10, respectively. The swivel deck 2 is mounted on the traveling device 1 through a swivel mechanism and is driven by a hydraulic motor 11 to swivel on a vertical axis P.

The driver's section 4 includes a driver's seat 12 and a control lever 13 disposed in front of the driver's seat 12 for controlling the traveling device 1. On both lateral sides of the driver's seat 12 there are provided working implement control levers 14 rockable crosswise for controlling the backhoe implement 3 and the swivel deck 2. The control levers 14 are disposed on top of right and left posts 16 extending vertically from a control block 15, respectively.

One of the working implement control levers 14 is operatively connected to a control valve V1 for controlling the hydraulic cylinder 8 which drives the boom 5, and to a control valve V2 for controlling the hydraulic cylinder 10 which drives the bucket 7.

The other working implement control lever 14 is operatively connected to a first valve V3 for controlling the hydraulic motor 11 which drives the swivel deck 2, and to a second valve V4 for controlling the hydraulic cylinder 9 which drives the arm 6. The control effected by this control lever 14 is switchable between two modes, i.e. a mode in which the swivel deck 2 is controlled by a sideways rocking movement of the lever 14 and the arm 6 is controlled by a fore-and-aft rocking movement of the lever 14, and a mode in which the arm 6 is controlled by the sideways rocking movement of the lever 14 and the swivel deck 2 is controlled by the fore-and-aft rocking movement of the lever 14.

FIGS. 2 through 5 show how the control lever 14 is operatively connected to the first valve V3 and the second valve V4. As seen, the post 16 houses a first pivotable member 18A supported by the post 16 to be pivotable on a fore-and-aft axis Q1 and a second pivotable member 18B attached to the first pivotable member 18A to be pivotable on a transverse axis Q2. The control lever 14 is attached to the second pivotable member 18B, whereby the control lever 14 is rockable crosswise in directions X—X and Y—Y. The post 16 further houses a first input rod 20A connected to the first pivotable member 18A through a universal joint 19A, and a second input rod 20B connected to the second pivotable member 18B through a universal joint 19B. Thus, a sideways operational force applied to the control rod 14 is transmitted through the first pivotable member 18A and the first input rod 20A, whereas a fore-and-aft operational force applied to the control rod 14 is transmitted through the second pivotable member 18B and the second input rod 20B, and these operational forces result in vertical push-pull movements of the input rods 20A and 20B in a lower position of the control block 15, respectively.

The control block 15 includes a relay support shaft 21 disposed adjacent a bottom thereof and supporting a first to a third bellcranks 22, 23 and 24 to be rotatable on a transverse axis Q3 of the relay support shaft 21. The first input rod 20A has a free end thereof disposed between an input arm 22A of the first bellcrank 22 and an input arm 23A of the second bellcrank 23, and the second input rod 20B has a free end thereof disposed between the input arm 23a of the second bellcrank 23 and an input arm 24A of the third bellcrank 24. The first bellcrank 22 and the third bellcrank 24 ar operatively connected to the first valve V3 through push-pull relay rods 25 and 26 connected to an output arm 22B of the first bellcrank 22 and an output arm 24B of the third bellcrank 24, respectively, a first relay bellcrank 27 connected to these push-pull relay rods 25 and 26, and a first output rod 28 connected to the first relay bellcrank 27. The second bellcrank 23 is operatively connected to the second valve V4 through a push-pull relay rod 29 connected to an output arm 23B of the second bellcrank 23, a second relay bellcrank 30 connected to the push-pull relay rod 29, and a second output rod 31 connected to the second relay bellcrank 30.

As noted above, the first input rod 20A and second input rod 20B extending through the post 16 have their respective free ends disposed between the input arms 22A, 23A and 24A of the first to third bellcranks 22, 23 and 24 disposed in the lower position of the control block 15. In order to operatively connect the first and second input rods 20A and 20B to the first to third bellcranks 22, 23 and 24, the input arms 22A and 23A of the first and second bellcranks 22 and 23 carry pivot pins 32 and 33 for connection to the first input rod 20A, respectively, and the input arms 23A and 24A of the second and third bellcranks 23 and 24 carry pivot pins 34 and 35 for connection to the second input rod 20B, respectively. When the controls for the first valve V3 and the second valve V4 are in neutral, the pivot pins 32 and 33 connectable to the first input rod 20A and the pivot pins 34 and 35 connectable to the second input rod 20B, respectively, are aligned on a common transverse axis Q4. With the pivot pins 32 and 33 connectable to the first input rod 20A aligned in a continuous manner on the same transverse axis Q4, the first input rod 20A is pivotable sideways such that the free end thereof is shiftable right and left, guided by the pivot pins 32 and 33 in alignment, between a position to engage the pivot pin 32 attached to the first bellcrank 22 and a position to engage the pivot pin 33 attached to the second bellcrank 23. Similarly, with the pivot pins 34 and 35 connectable to the second input rod 20B aligned in a continuous manner on the same transverse axis Q4, the second input rod 20B is pivotable sideways such that the free end thereof is shiftable right and left, guided by the pivot pins 34 and 35 in alignment, between a position to engage the pivot pin 34 attached to the second bellcrank 23 and a position to engage the pivot pin 35 attached to the third bellcrank 24.

FIGS. 2 through 5 further illustrate switching mechanisms 38 for switching the control mode or interlocking relationship between the first and second input rods 20A and 20B and the first to third bellcranks 22, 23 and 24. Each switching mechanism 38 comprises a switching mechanism mounting member 40, a fork member 36A straddling the input rod 20A or 20B, a pivot axis 36B mounted in the mounting member 40, and an arm member 36C carrying the fork member 36A and pivotable on the pivotal axis 36B for shifting the input rod 20A or 20B. The mounting member 40 is secured to the post 16.

Figure 2:
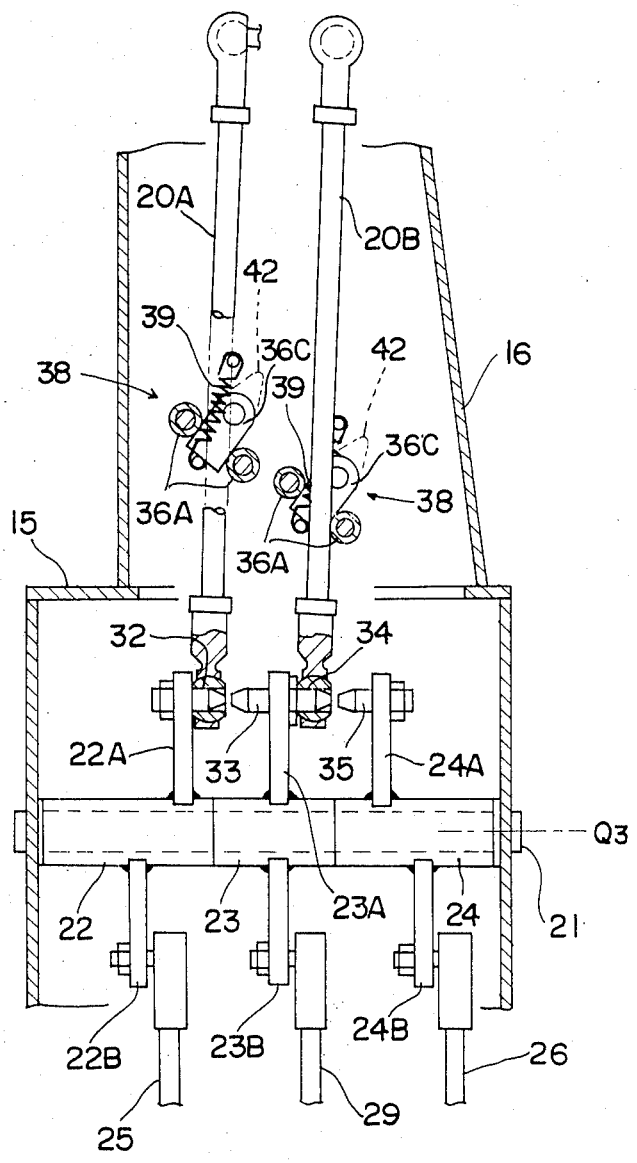
FIG. 2 is a front view of input rods and bellcranks in a first interlocking position.
Figure 4:
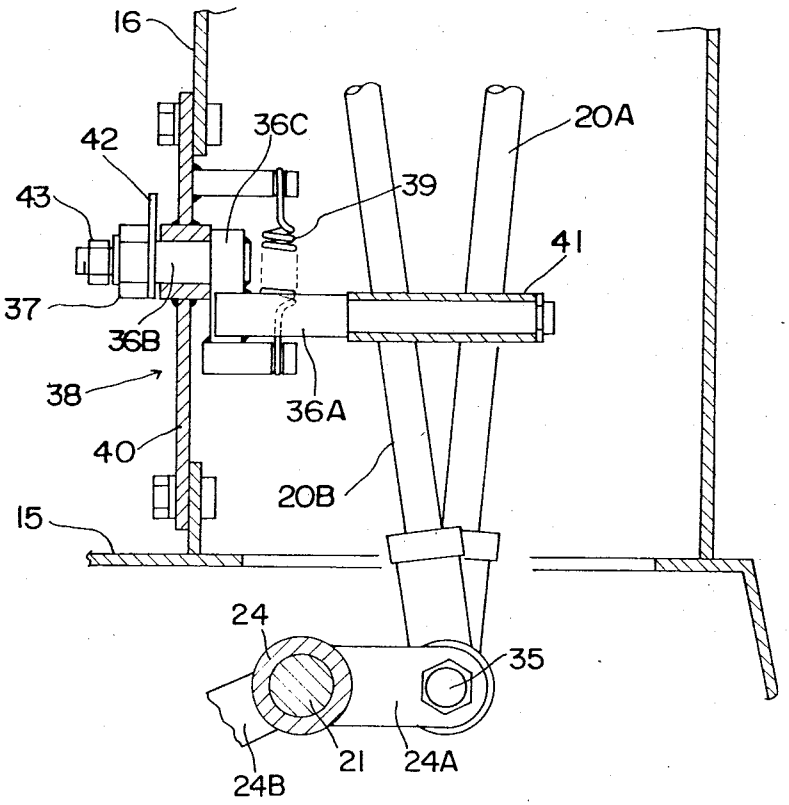
FIG. 4 is a side view partly broken away of a switch mechanism.
Figure 3:
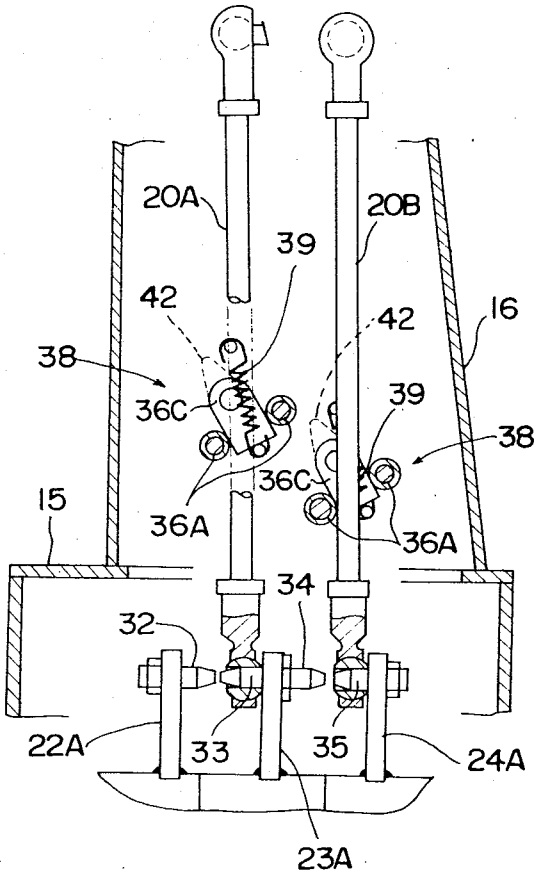
FIG. 3 is a front view of the input rods and bellcranks in a second interlocking position.
Figure 5:
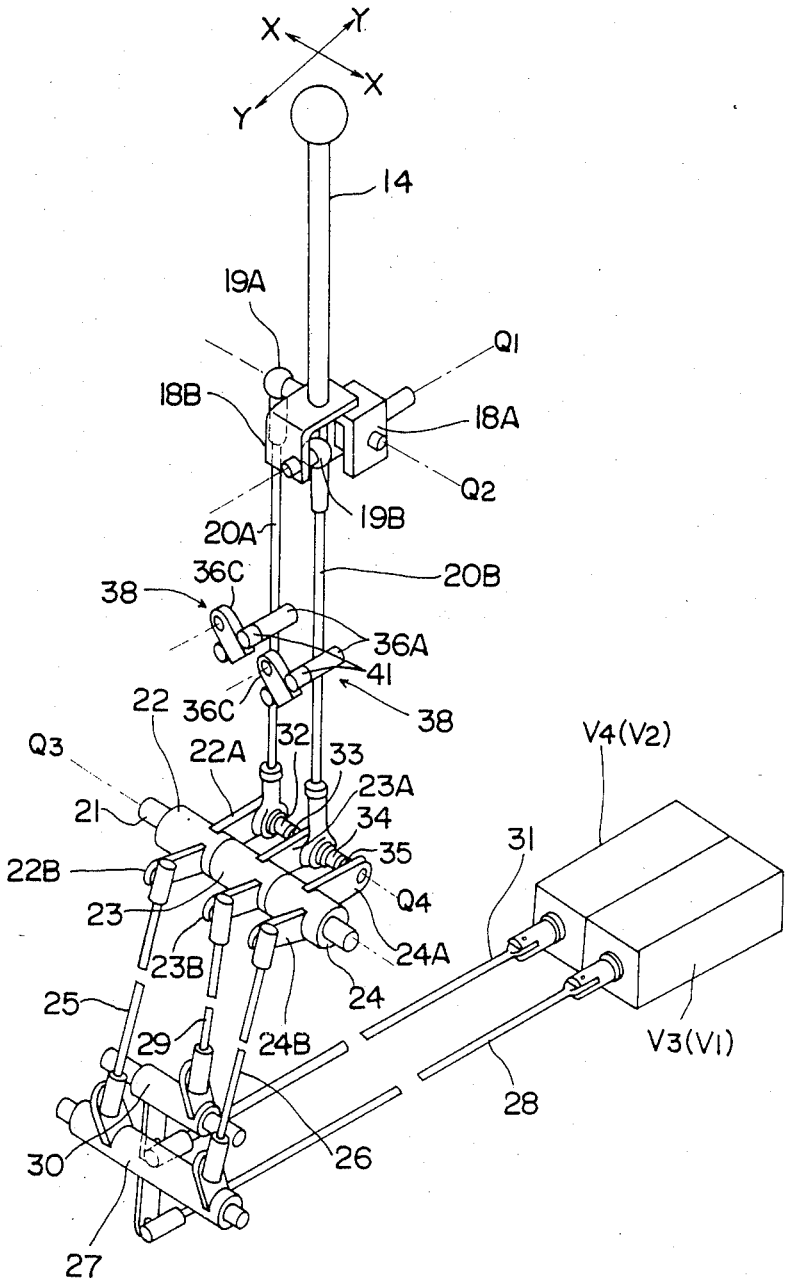
FIG. 5 is a perspective view of the valve control structure.

The switching mechanisms 38 are pivotable right and left to swing the first and second input rods 20A and 20B for selectively establishing the interlocking relationship between the first and second input rods 20A and 20B and the first to third bellcranks 22, 23 and 24. FIG. 2 shows a first interlocking relationship in which the first input rod 20A is placed in engagement with the pivot pin 32 of the first bellcrank 22 and the second input rod 20B with the pivot pin 34 of the second bellcrank 23. FIG. 3 shows a second interlocking relationship in which the first input rod 20A is placed in engagement with the pivot pin 33 of the second bellcrank 23 and the second input rod 20B with the pivot pin 35 of the second bellcrank 23.

A nut 37 is mounted on each pivotal axis 36B for locking the fork member 36A to the mounting member 40 to maintain a selected interlocking relationship. A lever or the like may be attached to the pivotal axis 36B for convenience in switching the interlocking relationship.

Each switching mechanism 38 further includes biasing means 39 whose biasing direction is variable with the switching from the first interlocking relationship to the second and vice versa, in order to retain the input rod 20A or 20B in its respective shift position. This biasing means 39 comprises a spring having one end thereof attached to the mounting member 40 and the other end attached to the arm member 36C such that, when the input rod 20A or 20B is in either shift position, the spring 39 has a line of action lying on the same side of the pivotal axis 36B on which that shift position lies.

Each of the fork members 36A carries a pair of collars 41 rotatable on transverse axes, which collars 41 are mounted where the fork member 36 A is in sliding contact with the input rod 20A or 20B at both sides thereof. This provision reduces friction due to the vertical push-pull movements of the first and second input rods 20A and 20B.

Number 42 in the drawings denotes indicator plates for indicating switching directions of the switching mechanisms 38. Number 43 denotes retainer nuts for retaining the nuts 37 in position, respectively.

Figure 6:
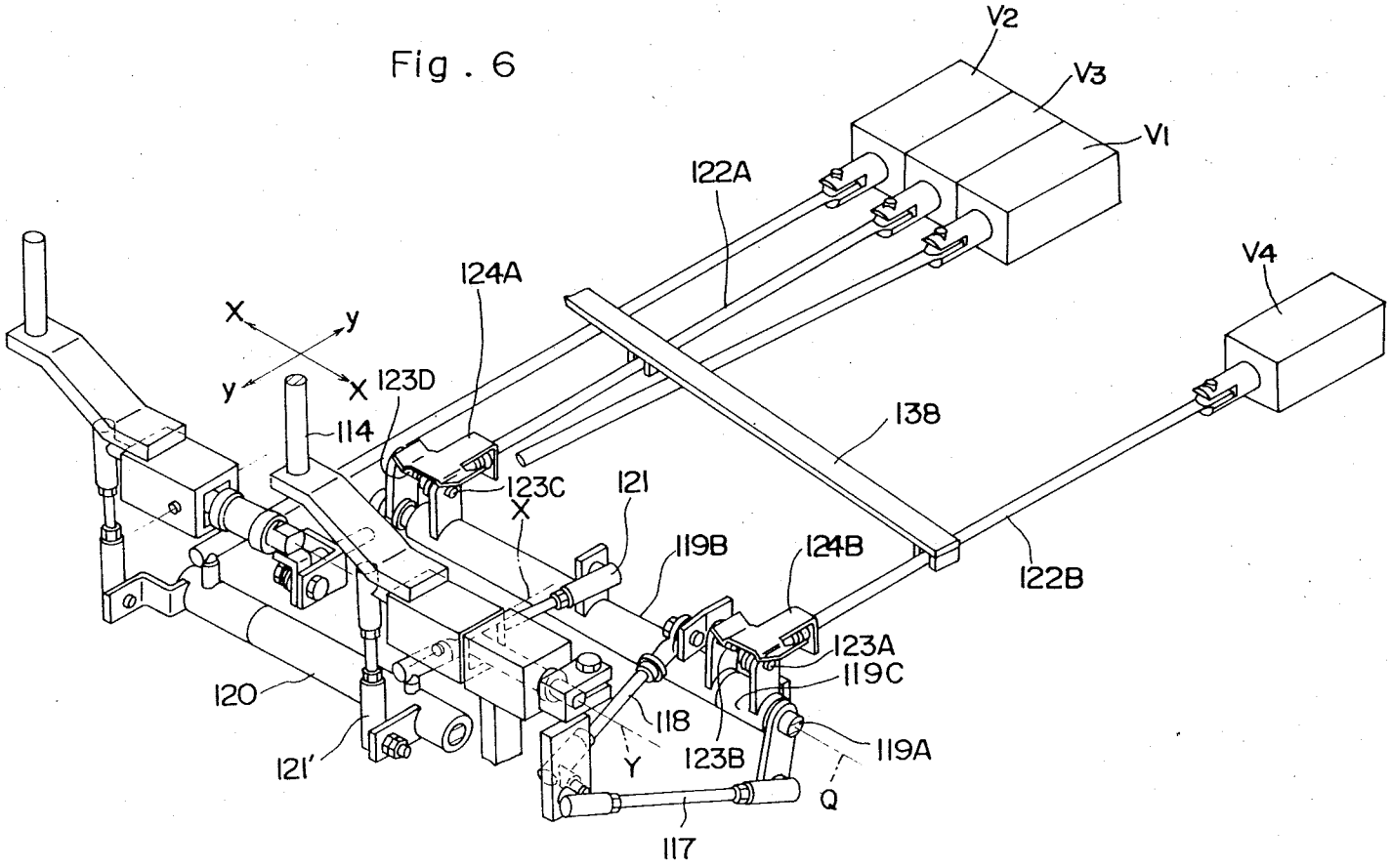
FIG. 6 is a perspective view of a modified valve control structure.
Figure 7:
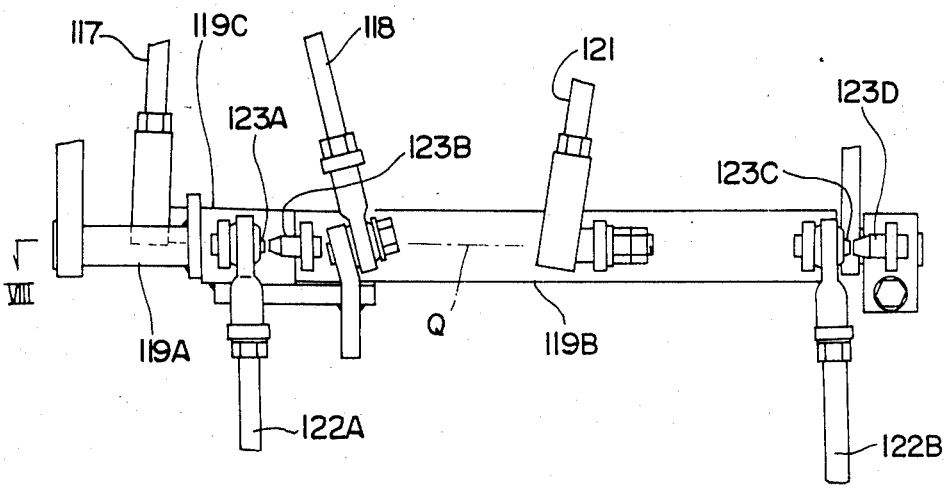
FIG. 7 is a plan view of bellcranks and output rods in the modified valve control structure.
Figure 8:
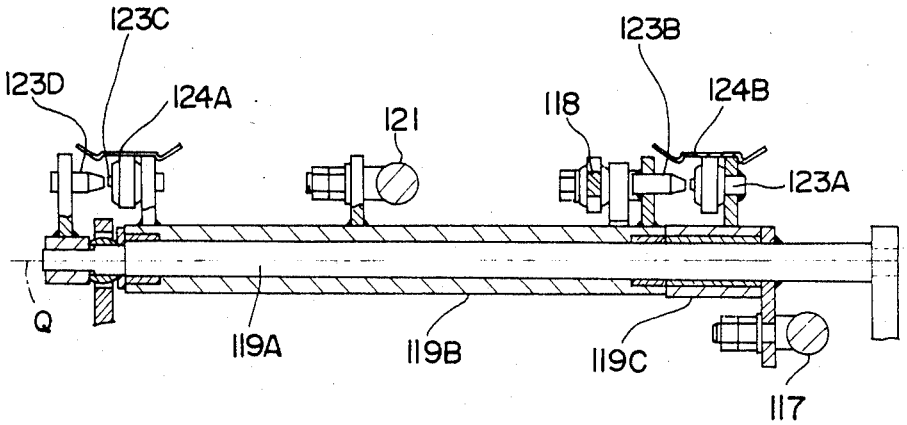
FIG. 8 is a sectional view taken on line VIII—VIII of FIG. 7.
Figure 9:
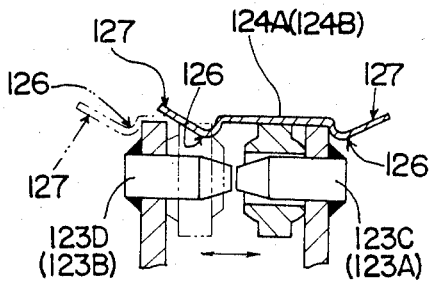
FIG. 9 is a sectional front view of the forward end of an output rod in the modified valve control structure.
Figure 10:
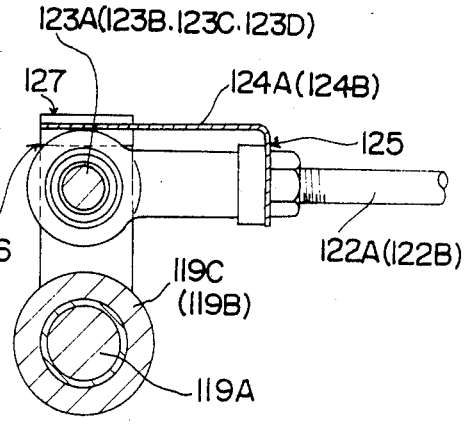
FIG. 10 is a sectional side view of the forward end of the output rod.
Figure 11:
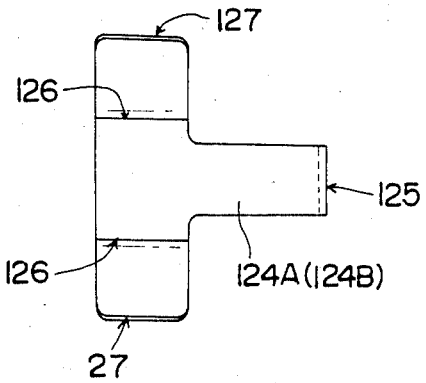
FIG. 11 is a plan view of a leaf spring mounted on the forward end of the output rod.

In the foregoing valve control structure embodying the present invention, the interlocking relationship between the input rods and the bellcranks is switched by varying the positions of connection therebetween. A modified embodiment will now be described with reference to FIGS. 6 through 8 in which the switching is effected by varying positions of connection between the bellcranks and the output rods.

Figure 12:
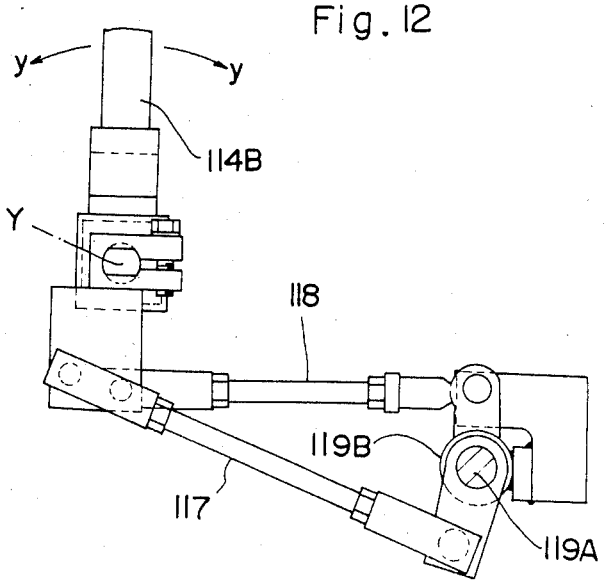
FIG. 12 is a side view showing bellcranks in the modified structure are operatively connected to a control lever.

The modified embodiment includes a first bellcrank 119A, a second bellcrank 119B and a third bellcrank 119C supported to be rotatable on a common axis Q. The first bellcrank 119A and the third bellcrank 119C are operatively connected to a control lever 114 through a second outer input rod 117 and a second inner input rod 118, respectively, (FIG. 12) to be rotatable in opposite directions relative to each other by fore-and-aft rocking movements y—y of the control lever 114. The second bellcrank 119B is operatively connected to the control lever 114 through an input relay rod mechanism 120 comprising a relay rod 120' and through a first rod means comprising a first input rod 121, to be rotatable by sideways rocking movements x—x of the control lever 114. The third bellcrank 119C includes a first joint 123A integral therewith, and the second bellcrank 119B includes a second joint 123B integral therewith. Between the first and second joints 123A and 123B there is disposed a free end of a second output rod 122B connected to the second valve V4, the second output rod 122B being pivotable so that the free end thereof is movable relative to the first and second joints 123A and 123B. Similarly, the second bellcrank 119B further includes a third joint 123C integral therewith, and the first bellcrank 119A includes a fourth joint 123D integral therewith. Between the third and fourth joints 123C and 123D there is disposed a free end of a first output rod 122A connected to the first valve V3, the first output rod 122A being pivotable so that the free end thereof is movable relative to the third and fourth joints 123C and 123D.

A switching mechanism 138 is provided to cause pivotal movements of the first and second output rods 122A and 122B in order to selectively establish a first interlocking relationship and a second interlocking relationship. In the first interlocking relationship, the first output rod 122A is placed in engagement with the third joint 123C and the second output rod 122B with the first joint 123A. In the second interlocking relationship, the first output rod 122A is placed in engagement with the fourth joint 123D and the second output rod 122B with the second joint 123B.

It is to be noted that the second and third bellcranks 119B and 119C are mounted on the first bellcrank 119A to be rotatable relative thereto.

Referring to FIGS. 8 through 11, the first output rod 122A carries a first leaf spring 124A which engages the third joint 123C of the second bellcrank 119B at times of the first interlocking relationship and the fourth joint 123D of the first bellcrank 119A at times of the second interlocking relationship. Further, the second output rod 122B carries a second leaf spring 124B which engages the first joint 123A of the third bellcrank 119C at times of the first interlocking relationship and the second joint 123B of the second bellcrank 119B at times of the second interlocking relationship.

Each of the first and second leaf springs 124A and 124B includes an attachment portion 125 for mounting on the output rod 122A or 122B, right and left engagement portions 126 for engaging the joints 123, and inclined guide portions 127 for guiding the engagement portions 126 into engagement with the joints 123, respectively.

The first and second output rods 122A and 122B may be operatively connected to the control lever 114 to be constantly operable by either one of the sideways rocking movements x-x and the fore-and-aft rocking movements of the control lever 114, respectively. The first to third bellcranks 119A, 119B and 119C may constantly be operatively connected to either one of the first and second valves V3 and V4, respectively.

Figure 13:
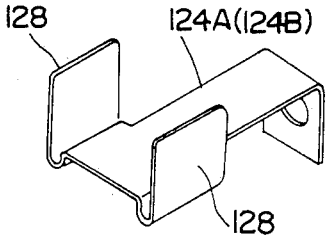
FIG. 13 is a perspective view of a modified leaf spring.

As shown in FIG. 13, each of the first and second leaf springs 124A and 124B may include, instead of the guide portions 127, hold portions 128 projecting vertically upwardly to be held and swung manually for facility of the switching operation.

The pivotal switching movements of the output rods 122A and 122B between the first and second interlocking relationships may be effected manually by directly holding the switching mechanism or the output rods 122A and 122B. Alternatively, a switching control element may be provided for switching the two output rods 122A and 122B. In the latter instance, the switching between the first and second interlocking relationships can be effected from outside without necessitating the opening and closing of a cover or covers provided on the vehicle body for enclosing the valve control structure.

What is claimed is:

1. A valve control structure for a working vehicle comprising;

a control lever rockable crosswise, a first input rod means operatively connected to said control lever to be pushed and pulled by rocking movements in a first direction of said control lever, a second input rod means operatively connected to said control lever to be pushed and pulled by rocking movements in a second direction of said control lever, a first output rod means connected to a first valve, a second output rod means connected to a second valve, and interlock switching means provided between said first and second input rod means and said first and second output rod means, said interlock switching means including a first bellcrank mechanism connected to said first output rod means and connectable to said first input rod means, a second bellcrank mechanism connected to said second output rod means and selectively connectable to said first input rod means and said second input rod means, a third bellcrank mechanism connected to said first output rod means and connectable to said second input rod means, and a switch mechanism for shifting said first and second input rod means in directions crossing longitudinal axes thereof, wherein said interlock switching means is operable through said switch mechanism to effect switching selectively between a first interlocking relationship in which said first input rod means is connected to said first bellcrank mechanism and said second input rod means is connected to said second bellcrank mechanism thereby to control said first valve with rocking movements in said first direction of said control lever and to control said second valve with rocking movements in said second direction of said control lever, and a second interlocking relationship in which said first input rod means is connected to said second bellcrank mechanism and said second input rod means is connected to said third bellcrank mechanism thereby to control said second valve with the rocking movements in said first direction of said control lever and to control said first valve with the rocking movements in said second direction of said control lever.

2. A valve control structure as claimed in claim 1 wherein said interlock switching means further includes biasing means having a biasing direction variable with the switching from said first interlocking relationship to said second interlocking relationship and vice versa, in order to retain said first and second input rod means in respective shift positions thereof.

3. A valve control structure as claimed in claim 2 wherein said switching mechanism comprises a switching mechanism mounting member, fork members straddling said first and second input rod means, respectively, pivot axes mounted in said mounting member, and arm members carrying said fork members and pivotable on said pivotal axes, respectively, for shifting said first and second input rod means.

4. valve control structure as claimed in claim 3 wherein said biasing means comprises springs each having one end thereof attached to one of said mounting members and the other end attached to one of said arm members and the other end attached to one of is in either shift position, said spring has a line of action lying on the same side of one of said pivotal axes on which that shift position lies.

5. A valve control structure for a working vehicle comprising;

a control lever rockable crosswise, a first input rod means operatively connected to said control lever to be pushed and pulled by rocking movements in a first direction of said control lever, a second input rod means operatively connected to said control lever to be pushed and pulled by rocking movements in a second direction of said control lever, a first output rod means connected to a first valve, a second output rod means connected to a second valve, and interlock switching means provided between said first and second input rod means and said first and second output rod means, said interlock switching means including a first bellcrank mechanism connected to said second input rod means and connectable to said first output rod means, a second bellcrank mechanism connecded to said first input rod means and selectively connectable to said first output rod means and said second output rod means, a third bellcrank mechanism connected to said second input rod means and connectable to said second output rod means, and a switch mechanism for shifting said first and second output rod means in directions crossing longitudinal axes thereof.

wherein said interlock switching means is operable through said switch mechanism to effect switching selectively between a first interlocking relationship in which said first output rod means is connected to said second bellcrank mechanism and said second output rod means is connected to said third bellcrank mechanism thereby to control said first valve with rocking movements in said first direction of said control lever and to control said second valve with rocking movements in said second direction of said control lever, and a second interlocking relationship in which said second output rod means is connected to said second bellcrank mechanism and first second output rod means is connected to said first bellcrank mechanism thereby to control said second valve with the rocking movements in said first direction of said control lever and to control said first valve with the rocking movements in said second direction of said control lever.

6. A valve control structure as claimed in claim 5 wherein said interlock switching means further includes biasing means having a biasing direction variable with the switching from said first interlocking relationship to said second interlocking relationship abd vice versa, in order to retain said first and second output rod means in respective shift positions thereof.

7. A valve control structure as claimed in claim 6 wherein said biasing means comprises a first position setting leaf spring mounted on said first output rod means for engaging said second bellcrank mechanism at times of said first interlocking relationship and for engaging said first bellcrank mechanism at times of said second interlocking relationship, and a second position setting leaf spring mounted on said second output rod means for engaging said third bellcrank mechanism at times of said first interlocking relationship and for engaging said second bellcrank mechanism at times of said second interlocking relationship.

* * * * *